US010262600B2

(12) United States Patent
Xing et al.

(10) Patent No.: US 10,262,600 B2
(45) Date of Patent: Apr. 16, 2019

(54) METHOD AND APPARATUS FOR GRAYSCALE ADJUSTMENT

(71) Applicants: Shenzhen China Star Optoelectronics Technology Co., Ltd., Shenzhen (CN); Wuhan China Star Optoelectronics Technology Co., Ltd., Wuhan (CN)

(72) Inventors: Zhenzhou Xing, Shenzhen (CN); Bin Xiong, Shenzhen (CN)

(73) Assignees: Shenzhen China Star Optoelectronics Technology Co., Ltd., Shenzhen (CN); Wuhan China Star Optoelectronics Technology Co., Ltd., Wuhan (CN)

( * ) Notice: Subject to any disclaimer, the term of this patent is extended or adjusted under 35 U.S.C. 154(b) by 525 days.

(21) Appl. No.: 14/893,079

(22) PCT Filed: Sep. 8, 2015

(86) PCT No.: PCT/CN2015/089102
§ 371 (c)(1),
(2) Date: Nov. 23, 2015

(87) PCT Pub. No.: WO2017/031787
PCT Pub. Date: Mar. 2, 2017

(65) Prior Publication Data

US 2017/0061845 A1 Mar. 2, 2017

(30) Foreign Application Priority Data

Aug. 27, 2015 (CN) ..... 2015 1 0537267

(51) Int. Cl.
*G09G 3/34* (2006.01)
*G09G 3/20* (2006.01)

(52) U.S. Cl.
CPC ..... *G09G 3/342* (2013.01); *G09G 3/2003* (2013.01); *G09G 2320/0233* (2013.01); *G09G 2320/0271* (2013.01); *G09G 2320/0646* (2013.01)

(58) Field of Classification Search
CPC ..... G09G 3/2003; G09G 3/36; G09G 3/342
See application file for complete search history.

(56) References Cited

U.S. PATENT DOCUMENTS 8,054,286 B2 * 11/2011 Feng ..... G09G 3/3648 345/102
9,734,749 B2 * 8/2017 Hwang ..... G09G 3/2074
(Continued)

FOREIGN PATENT DOCUMENTS

CN 104064156 9/2014
CN 104157262 11/2014
(Continued)

*Primary Examiner* — Alexander Eisen
*Assistant Examiner* — Mansour Said

(57) ABSTRACT

A method and apparatus for grayscale adjustment are provided. The method includes steps of: obtaining pixel grayscale values or at least one region grayscale value of an original image; selecting a predetermined grayscale compensation interval, from multiple predetermined grayscale compensation intervals, which corresponds to the pixel grayscale values or the region grayscale value as a ready-to-use grayscale compensation interval; obtaining a grayscale compensation value which corresponds to the ready-to-use grayscale compensation interval; and performing compensation on pixel grayscale values of the original image according to the grayscale compensation value.

3 Claims, 5 Drawing Sheets

(56) References Cited

U.S. PATENT DOCUMENTS

| | | | | |
|---|---|---|---|---|
| 2005/0088379 | A1* | 4/2005 | Tsuchida | G09G 3/3258 345/76 |
| 2006/0077199 | A1* | 4/2006 | Liao | G09G 3/2007 345/211 |
| 2014/0107438 | A1 | 4/2014 | Song | |
| 2014/0160174 | A1* | 6/2014 | Tsuei | G09G 3/2003 345/690 |
| 2015/0255025 | A1* | 9/2015 | Chen | H04N 9/3182 345/589 |
| 2016/0180765 | A1 | 6/2016 | Hwang et al. | |
| 2016/0253968 | A1 | 9/2016 | Fu et al. | |
| 2016/0260368 | A1 | 9/2016 | Zheng | |

FOREIGN PATENT DOCUMENTS

| | | |
|---|---|---|
| CN | 104505010 | 4/2015 |
| CN | 104699438 | 6/2015 |
| KR | 10-2014-0048791 | 3/2017 |

* cited by examiner

METHOD AND APPARATUS FOR GRAYSCALE ADJUSTMENT

RELATED APPLICATIONS

This application is a National Phase of PCT Patent Application No. PCT/CN2015/089102 having International filing date of Sep. 8, 2015, which claims the benefit of priority of Chinese Patent Application No. 201510537267.9, filed on Aug. 27, 2015. The contents of the above applications are all incorporated by reference as if fully set forth herein in their entirety.

BACKGROUND OF THE INVENTION

Field of the Invention

The present invention relates to the technical field of display devices, and more particularly to a grayscale adjustment method and a grayscale adjustment apparatus.

Description of the Related Art

At present, the display screen of a smartphone becomes larger, thereby requiring a larger display module for the smartphone. However, with the size of the display module of smartphones continuously becomes larger, a problem of uneven display quality of the display module arises. In order to solve the problem, a conventional solution is to improve the structure and composition of the backlight source, such as using a content-adaptive backlight control (CABC) technology. The content-adaptive backlight control technology is able to automatically adjust the brightness of the backlight source so as to achieve an effect of reducing power consumption. However, this technology can only improve a part of the problem of uneven display quality, and is unable to entirely improve the problem.

Hence, it is necessary to provide a grayscale adjustment method and a grayscale adjustment apparatus to overcome the problems existing in the conventional technology.

SUMMARY OF THE INVENTION

An objective of the present invention is to provide a grayscale adjustment method and a grayscale adjustment apparatus in order to solve a technical problem, in the prior art, that display panels have a technical problem of uneven display brightness.

In order to solve the above technical problem, the present invention provides a grayscale adjustment method having steps of:

obtaining an image grayscale value of an original image inputted by a liquid crystal display panel;

selecting a predetermined grayscale compensation interval, from multiple predetermined grayscale compensation intervals, which corresponds to the image grayscale value as a ready-to-use grayscale compensation interval; wherein the predetermined grayscale compensation interval is set with a grayscale compensation value;

obtaining the grayscale compensation value which corresponds to the ready-to-use grayscale compensation interval; and performing compensation on pixel grayscale values of the original image according to the grayscale compensation value.

In the grayscale adjustment method of the present invention, the image grayscale value is an average value of all of the pixel grayscale values of the original image inputted by the liquid crystal display panel; and the step of performing compensation on pixel grayscale values of the original image according to the grayscale compensation value further includes a step of:

performing compensation on the pixel grayscale values of the entire original image according to the grayscale compensation value.

In the grayscale adjustment method of the present invention, the predetermined grayscale compensation interval is set based on an experience value, and the grayscale compensation value is set based on brightness uniformity testing data of a backlight source.

In the grayscale adjustment method of the present invention, the method further includes:

obtaining display brightness and transmittance of the liquid crystal display panel when displaying the original image;

obtaining a backlight adjustment ratio and an auxiliary compensation value corresponding thereto according to the display brightness and transmittance of the liquid crystal display panel;

performing compensation on the pixel grayscale values of the original image according to the auxiliary compensation value.

In the grayscale adjustment method of the present invention, the method further includes:

lowering the brightness of a backlight source to a value to which the backlight adjustment ratio corresponds.

In order to solve the above technical problem, the present invention provides another grayscale adjustment method having steps of:

obtaining at least one region grayscale value of an original image inputted by a liquid crystal display panel;

selecting a predetermined grayscale compensation interval, from multiple predetermined grayscale compensation intervals, which corresponds to the region grayscale value as a ready-to-use grayscale compensation interval; wherein the predetermined grayscale compensation interval is set with a grayscale compensation value;

obtaining the grayscale compensation value which corresponds to the ready-to-use grayscale compensation interval; and performing compensation on pixel grayscale values of the original image according to the grayscale compensation value.

In the grayscale adjustment method of the present invention, the step of obtaining at least one region grayscale value of an original image inputted by a liquid crystal display panel further includes steps of:

dividing the liquid crystal panel into at two predetermined regions;

obtaining an average of pixel grayscale values of the original image to which the predetermined regions correspond;

the step of performing compensation on pixel grayscale values of the original image according to the grayscale compensation value further includes a step of:

performing compensation, based on the grayscale compensation value, on the pixel grayscale values of the original image to which the predetermined regions correspond.

In the grayscale adjustment method of the present invention, the liquid crystal display panel includes at least two pixel rows or at least two pixel columns, and the predetermined region corresponds to the pixel rows or the pixel columns.

In the grayscale adjustment method of the present invention, the predetermined grayscale compensation interval is set based on an experience value, and the grayscale compensation value is set based on brightness uniformity testing data of a backlight source.

In the grayscale adjustment method of the present invention, the method further includes:

obtaining display brightness and transmittance of the liquid crystal display panel when displaying the original image;

obtaining a backlight adjustment ratio and an auxiliary compensation value corresponding thereto according to the display brightness and transmittance of the liquid crystal display panel;

performing compensation on the pixel grayscale values of the original image according to the auxiliary compensation value.

In the grayscale adjustment method of the present invention, the method further includes:

lowering the brightness of a backlight source to a value to which the backlight adjustment ratio corresponds.

The present invention further provides a grayscale adjustment apparatus including:

a liquid crystal display panel;

a backlight source;

a grayscale-value obtaining module used to obtain an image grayscale value or at least one region grayscale value of an original image inputted by a liquid crystal display panel;

a ready-to-use grayscale compensation interval obtaining module being used to select a predetermined grayscale compensation interval, from multiple predetermined grayscale compensation intervals, which corresponds to the image grayscale value or the region grayscale value as a ready-to-use grayscale compensation interval; wherein the predetermined grayscale compensation interval is set with a grayscale compensation value;

a grayscale compensation value obtaining module being used to obtain the grayscale compensation value to which the ready-to-use grayscale compensation interval corresponds; and a first compensation module being used to perform compensation on pixel grayscale values of the original image according to the grayscale compensation value.

In the grayscale adjustment apparatus of the present invention, the grayscale-value obtaining module is further used to obtain an average of all pixel grayscale values of the original image inputted by the liquid crystal display panel;

the first compensation module is further used to perform compensation on the pixel grayscale values of the entire original image according to the grayscale compensation value.

In the grayscale adjustment apparatus of the present invention, the grayscale-value obtaining module is further used to divide the liquid crystal panel into at two predetermined regions, and obtain an average of pixel grayscale values of the original image to which the predetermined regions correspond; the first compensation module is further used to perform compensation, based on the grayscale compensation value, on the pixel grayscale values of the original image to which the predetermined regions correspond.

In the grayscale adjustment apparatus of the present invention, the liquid crystal display panel includes at least two pixel rows or at least two pixel columns, and the predetermined region corresponds to the pixel rows or the pixel columns.

In the grayscale adjustment apparatus of the present invention, the predetermined grayscale compensation interval is set based on an experience value, and the grayscale compensation value is set based on brightness uniformity testing data of a backlight source.

In the grayscale adjustment apparatus of the present invention, the grayscale adjustment apparatus further includes a display brightness and transmittance obtaining module, an auxiliary compensation value obtaining module, and a second compensation module;

the display brightness and transmittance obtaining module is used to obtain display brightness and transmittance of the liquid crystal display panel when displaying the original image;

the auxiliary compensation value obtaining module is used to obtain a backlight adjustment ratio and an auxiliary compensation value corresponding thereto according to the display brightness and transmittance of the liquid crystal display panel;

the second compensation module is used to perform compensation on the pixel grayscale values of the original image according to the auxiliary compensation value.

In the grayscale adjustment apparatus of the present invention, the grayscale adjustment apparatus further includes a backlight adjustment module; and the backlight adjustment module is used to lower the brightness of a backlight source to a value to which the backlight adjustment ratio corresponds.

In the method and apparatus for grayscale adjustment of the present invention, by obtaining the grayscale average of an image, obtaining a corresponding compensation value based on the grayscale average, and then performing compensation on the grayscale of the image with the compensation value, is able to render the displayed image more uniform, thereby enhancing display quality.

DETAILED DESCRIPTION OF THE PREFERRED EMBODIMENTS

The foregoing objects, features and advantages adopted by the present invention can be best understood by referring to the following detailed description of the preferred embodiments and the accompanying drawings. Furthermore, the directional terms described in the present invention, such as upper, lower, front, rear, left, right, inner, outer, side and etc., are only directions referring to the accompanying drawings, so that the used directional terms are used to describe and understand the present invention, but the present invention is not limited thereto.

Figure 1:
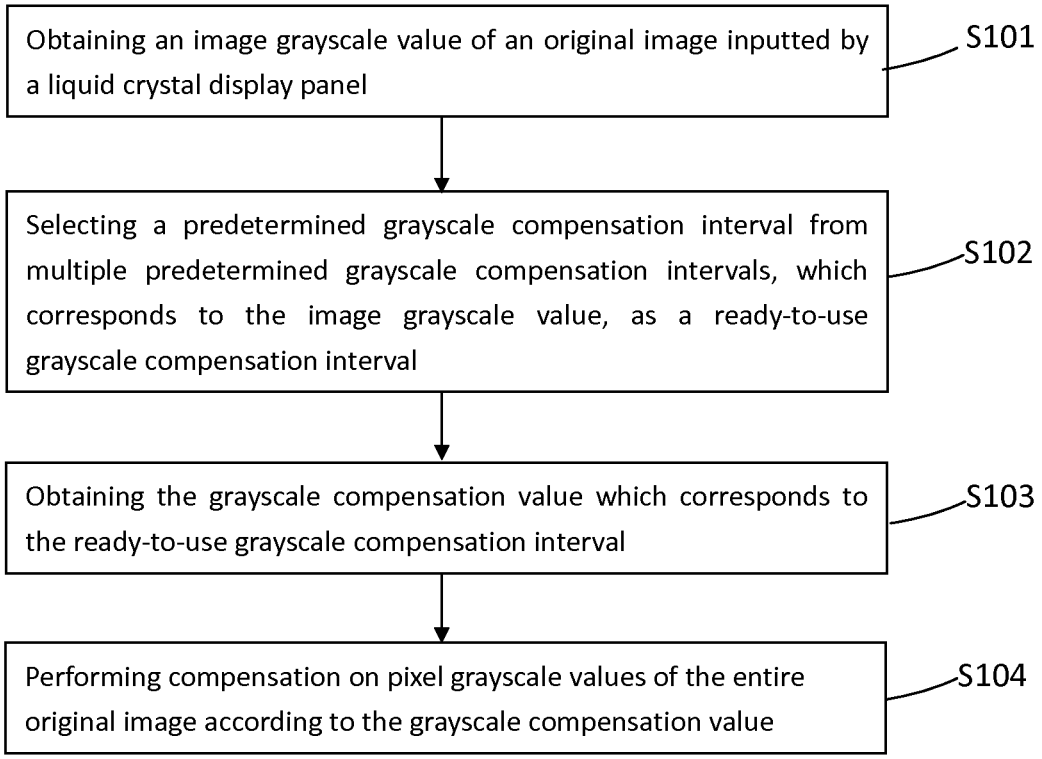
FIG. 1 is a flowchart of a grayscale adjustment method according to a first embodiment of the present invention.

With reference to FIG. 1, FIG. 1 is a flowchart of a grayscale adjustment method according to a first embodiment of the present invention. The grayscale adjustment method of the present invention includes steps of:

S101: obtaining an image grayscale value of an original image inputted by a liquid crystal display panel; wherein the liquid crystal display panel inputs an original, and the original image has multiple pixel grayscale values.

S102: selecting a predetermined grayscale compensation interval from multiple predetermined grayscale compensation intervals, which corresponds to the image grayscale value as a ready-to-use grayscale compensation interval; wherein the image grayscale value is an average value of all of the pixel grayscale values of the original image inputted by the liquid crystal display panel. The predetermined grayscale compensation interval is set with a grayscale compensation value.

For example, an overall image grayscale value is divided into 16 intervals: [0~15], [16~31], . . . , [239~255] in advanced, thus forming 16 predetermined grayscale compensation intervals, wherein the predetermined grayscale compensation interval respectively correspond to adjustment factors a1, a2, . . . , a16. The adjustment factors a1, a2, . . . , a16 may be obtained according to the brightness uniformity testing data of a backlight source provided by backlight module manufacturers. The predetermined grayscale compensation intervals may be set based on an experience value.

For example, when the image grayscale value is 17, the grayscale compensation interval that is ready to be used (hereinafter "ready-to-use grayscale compensation interval") will be the second predetermined grayscale compensation interval.

S103: obtaining the grayscale compensation value which corresponds to the ready-to-use grayscale compensation interval. Based on the ready-to-use grayscale compensation interval obtained from step S102, that is, the second predetermined grayscale compensation interval, the corresponding grayscale compensation value of a2 is then obtained.

S104: performing compensation on the pixel grayscale values of the entire original image according to the grayscale compensation value. Based on the grayscale compensation value of a2 obtained from step S103, the pixel grayscale values of the original image is then corrected.

By performing compensation on the grayscale of the overall original image, the problem of uneven display quality occurred during the display process can be improved as a whole.

Figure 2:
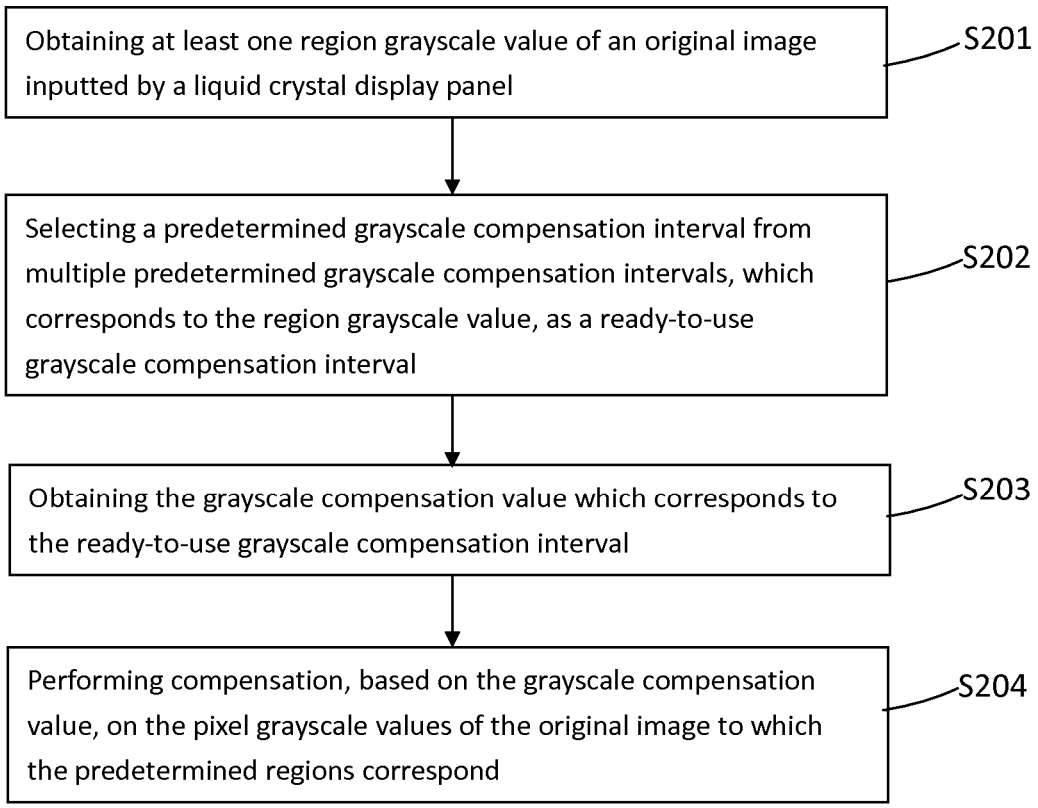
FIG. 2 is a flowchart of a grayscale adjustment method according to a second embodiment of the present invention.

With reference to FIG. 2, FIG. 2 is a flowchart of a grayscale adjustment method according to a second embodiment of the present invention.

S201: obtaining at least one region grayscale value of an original image inputted by a liquid crystal display panel; the step specifically includes the following steps of:

S301: dividing the liquid crystal panel into at two predetermined regions; wherein, preferably, the liquid crystal display panel includes at least two pixel rows or at least two pixel columns, and the predetermined region corresponds to the pixel rows or the pixel columns;

S302: obtaining an average of pixel grayscale values of the original image to which the predetermined regions correspond; wherein since there are multiple predetermined regions, by respectively calculating an average of the pixel grayscale values of the original image to which each of the predetermined regions corresponds, multiple region averages are generated.

S202: selecting a predetermined grayscale compensation interval from multiple predetermined grayscale compensation intervals, which corresponds to the region grayscale value as a ready-to-use grayscale compensation interval, wherein the predetermined grayscale compensation interval is set with a grayscale compensation value; obtain the predetermined grayscale compensation interval to which each region grayscale value corresponds;

S203: obtaining the grayscale compensation value which corresponds to the ready-to-use grayscale compensation interval; wherein each region grayscale value corresponds to one of the grayscale compensation value.

S204: performing compensation, based on the grayscale compensation value, on the pixel grayscale values of the original image to which the predetermined regions correspond.

For example, divide the liquid crystal display panel into the plurality of predetermined regions, such as divide it by pixel rows or pixel columns or divide it to have four regions at four sides and one regions at the center; next, obtain all of the pixel grayscale values of the original image; then calculate the average of the pixel grayscale values of the original image to which each predetermined region correspond (that is, the region grayscale value); then select a predetermined grayscale compensation interval according to each average; then use the predetermined grayscale compensation interval to which each average corresponds as a ready-to-use grayscale compensation interval; then obtain the plurality of grayscale compensation values according to the plurality of ready-to-use grayscale compensation intervals; and then use each of the grayscale compensation values to perform compensation on the pixel grayscale values of the original image to which the predetermined regions correspond.

For example, divide the liquid crystal display panel into three predetermined regions, wherein the first predetermined region may have a region grayscale value that is located at the fourth predetermined grayscale compensation interval, then use a4 to perform compensation on the pixel grayscale values of the original image in the first predetermined region; the second predetermined region may have a region grayscale value that is located at the eighth predetermined grayscale compensation interval, then use a8 to perform compensation on the pixel grayscale values of the original image in the second predetermined region; the third predetermined region may have a region grayscale value that is located at the fourteenth predetermined grayscale compensation interval, then use a14 to perform compensation on the pixel grayscale values of the original image in the third predetermined region.

Since in the present embodiment the region division is more precise than that in the first embodiment, the grayscale compensation in the present embodiment can render the displayed image even more uniform, thereby greatly improving the problem of uneven display.

Figure 3:
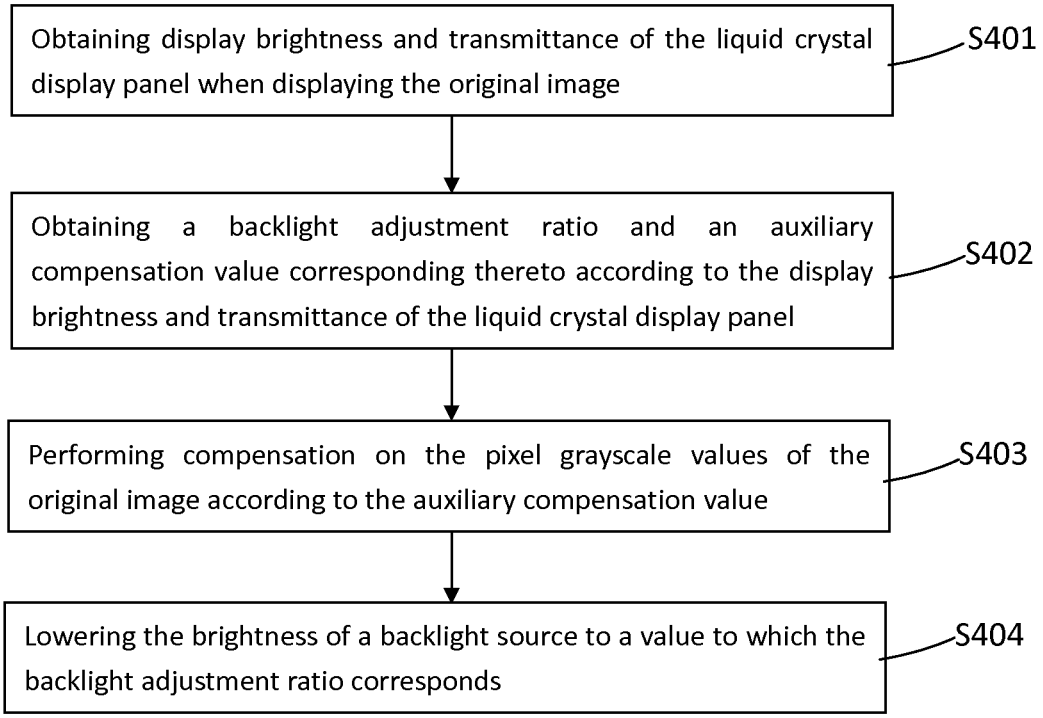
FIG. 3 is a flowchart of a grayscale adjustment method according to a third embodiment of the present invention.

Preferably, as shown in FIG. 3, the method for grayscale adjustment may further include steps of:

S401: obtaining display brightness and transmittance of the liquid crystal display panel when displaying the original image; wherein the step may be to obtain the overall display brightness and transmittance of the liquid crystal display panel or the display brightness and transmittance of multiple predetermined regions of the liquid crystal display panel. The step is executed to select a backlight adjustment ratio, based on the display brightness and transmittance from a predetermined lookup table of backlight adjustment ratio, wherein the predetermined lookup table of backlight adjustment ratio includes a plurality of intervals of display brightness and transmittance, and each of the intervals of display brightness and transmittance corresponds to a backlight adjustment ratio.

S402: obtaining a backlight adjustment ratio and an auxiliary compensation value corresponding thereto according to the display brightness and transmittance of the liquid crystal display panel; wherein by looking up the transmittance from the predetermined lookup table, a corresponding backlight adjustment ratio is obtained. For example, the backlight adjustment ratio may be −30% meaning to lower the brightness of the backlight source by 30%, and an auxiliary compensation value will be raise the grayscale brightness of the original image by 30%.

S403: performing compensation on the pixel grayscale values of the original image according to the auxiliary compensation value.

Preferably, the method further includes:

S404: lowering the brightness of a backlight source to a value to which the backlight adjustment ratio corresponds. By dynamically adjusting the brightness of the backlight source with the backlight adjustment ratio, the power consumption of the backlight source can be reduced.

The present embodiment may be further incorporated with a content-adaptive backlight control to perform compensation on the grayscale of the image inputted by the display panel so as to render the displayed image more uniform and lower the power consumption of the backlight source. The solutions of this embodiment may be applied to other embodiments.

Figure 4:
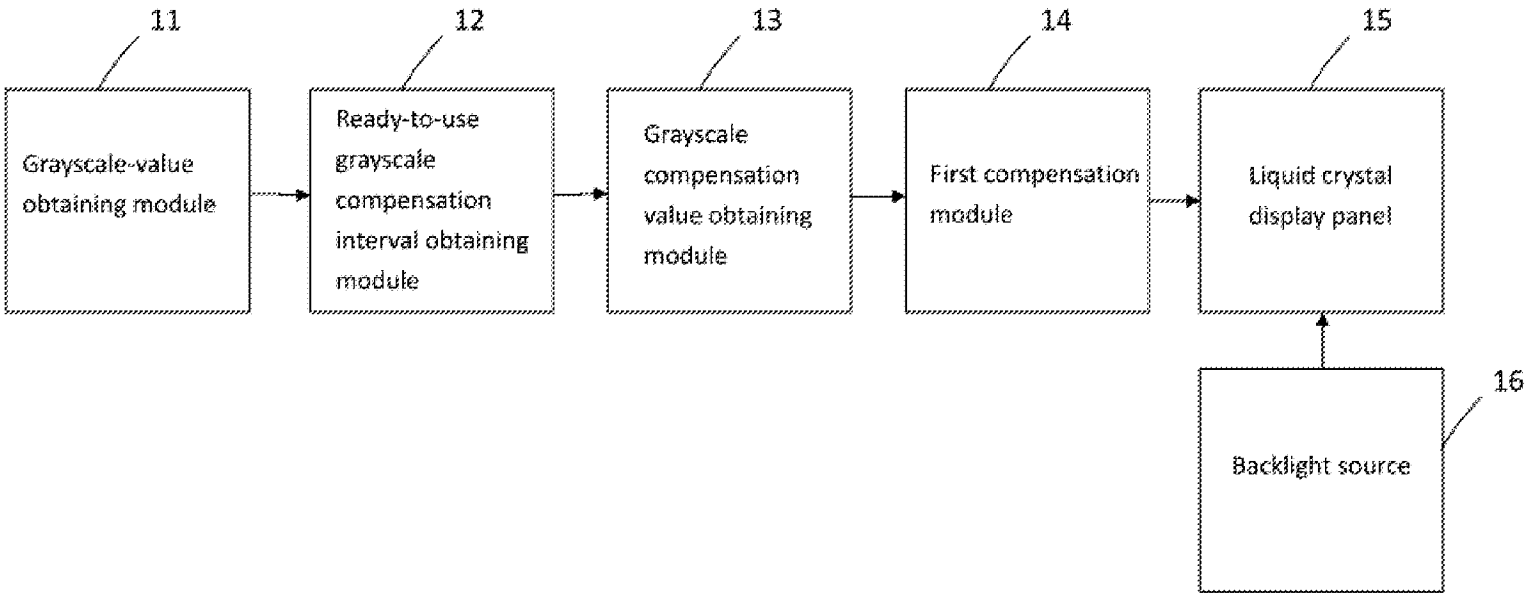
FIG. 4 is a structural diagram of a grayscale adjustment apparatus according to a first embodiment of the present invention.

With reference to FIG. 4, FIG. 4 is a structural diagram of a grayscale adjustment apparatus according to a first embodiment of the present invention.

As shown in FIG. 4, the present invention further provides a grayscale adjustment apparatus having a liquid crystal display panel 15, a backlight source 16, a grayscale-value obtaining module 11, a ready-to-use grayscale compensation interval obtaining module 12, a grayscale compensation value obtaining module 13 and a first compensation module 14.

The liquid crystal display panel 15 may include a first substrate and a second substrate. The first substrate may be an array substrate. The second substrate may be a color filter substrate. The first substrate may include a plurality of data lines and scanning lines, and a plurality of pixel rows or columns which are defined by the data lines and the scanning lines. The second substrate may include a common electrode. The backlight source is used to provide a backlight illuminance to the liquid crystal display panel.

The grayscale-value obtaining module 11 is used to obtain an image grayscale value or at least one region grayscale value of an original image inputted by a liquid crystal display panel.

The ready-to-use grayscale compensation interval obtaining module 12 is used to select a predetermined grayscale compensation interval from multiple predetermined grayscale compensation intervals, which corresponds to the image grayscale value or the region grayscale value as a ready-to-use grayscale compensation interval; wherein the predetermined grayscale compensation interval is set with a grayscale compensation value.

The grayscale compensation value obtaining module 13 is used to obtain the grayscale compensation value to which the ready-to-use grayscale compensation interval corresponds.

The first compensation module 14 is used to perform compensation on pixel grayscale values of the original image according to the grayscale compensation value.

Preferably, the grayscale-value obtaining module 11 is further used to obtain an average of all pixel grayscale values of the original image inputted by the liquid crystal display panel;

the first compensation module 14 is further used to perform compensation on the pixel grayscale values of the entire original image according to the grayscale compensation value.

Preferably, the grayscale-value obtaining module is further used to divide the liquid crystal panel into at two predetermined regions, and obtain an average of pixel grayscale values of the original image to which the predetermined regions correspond.

The first compensation module 14 is further used to perform compensation, based on the grayscale compensation value, on the pixel grayscale values of the original image to which the predetermined regions correspond.

Preferably, the liquid crystal display panel includes at least two pixel rows or at least two pixel columns, and the predetermined region corresponds to the pixel rows or the pixel columns.

Preferably, the predetermined grayscale compensation interval is set based on an experience value, and the grayscale compensation value is set based on brightness uniformity testing data of a backlight source.

Figure 5:
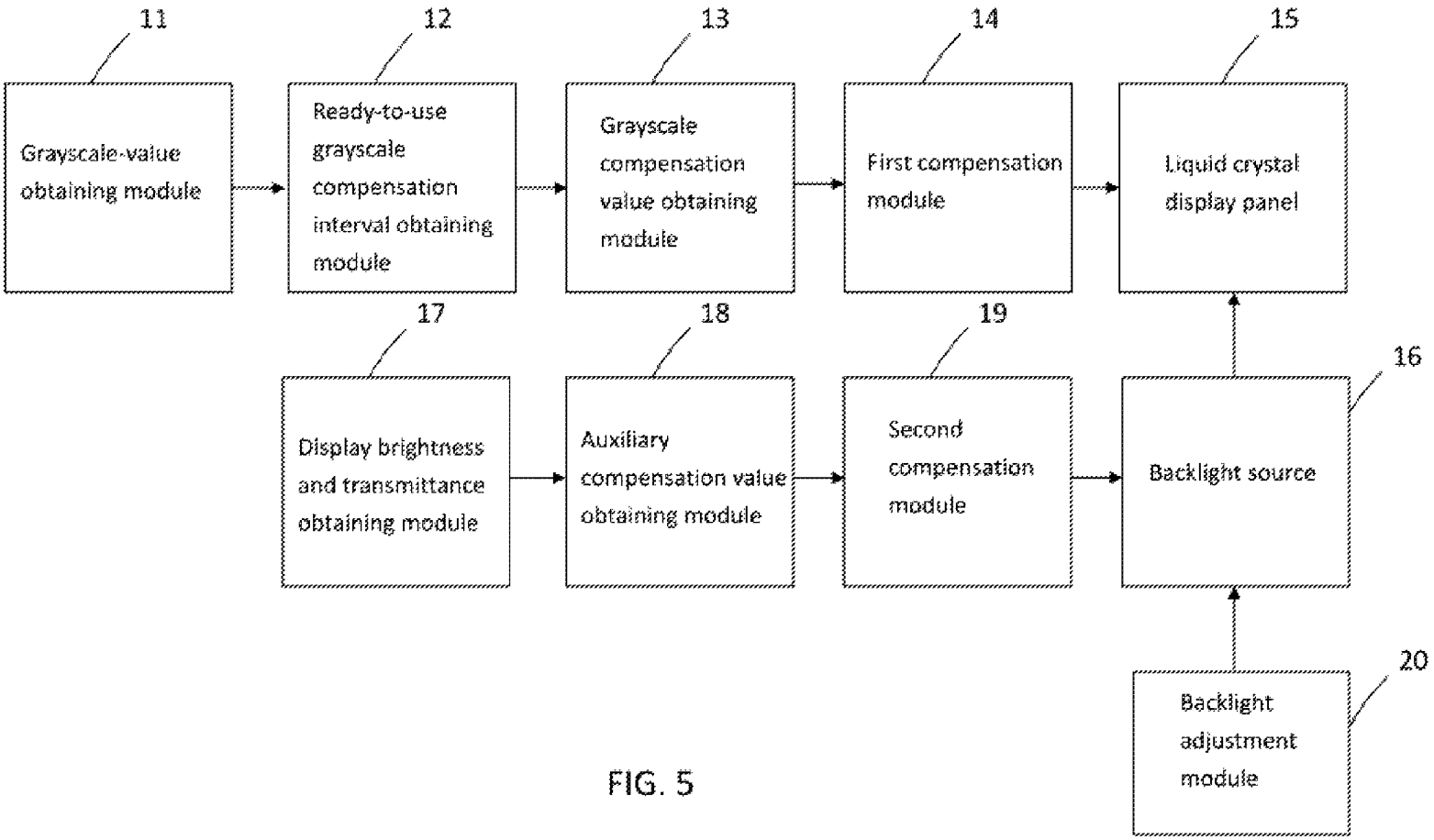
FIG. 5 is a structural diagram of a grayscale adjustment apparatus according to a second embodiment of the present invention.

Preferably, as shown in FIG. 5, the grayscale adjustment apparatus further includes a display brightness and transmittance obtaining module 17, an auxiliary compensation value obtaining module 18, and a second compensation module 19, and a backlight adjustment module 20.

The display brightness and transmittance obtaining module 17 is used to obtain display brightness and transmittance of the liquid crystal display panel when displaying the original image.

The auxiliary compensation value obtaining module 18 is used to obtain a backlight adjustment ratio and an auxiliary compensation value corresponding thereto according to the display brightness and transmittance of the liquid crystal display panel.

The second compensation module 19 is used to perform compensation on the pixel grayscale values of the original image according to the auxiliary compensation value.

The backlight adjustment module 20 is used to lower the brightness of a backlight source to a value to which the backlight adjustment ratio corresponds.

In the method and apparatus for grayscale adjustment of the present invention, by obtaining the grayscale average of an image, obtaining a corresponding compensation value based on the grayscale average, and then performing compensation on the grayscale of the image with the compensation value, is able to render the displayed image more uniform, thereby enhancing display quality.

In conclusion, although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A grayscale adjustment method, comprising steps of:

obtaining at least one region grayscale value of an original image inputted by a liquid crystal display panel; wherein the step of obtaining at least one region grayscale value of an original image inputted by a liquid crystal display panel further includes steps of: dividing the liquid crystal panel into at two predetermined regions; obtaining an average of pixel grayscale values of the original image to which the predetermined regions correspond;

selecting a predetermined grayscale compensation interval, from multiple predetermined grayscale compensation intervals, which corresponds to the region grayscale value as a ready-to-use grayscale compensation interval; wherein the predetermined grayscale compensation interval is set with a grayscale compensation value;

obtaining the grayscale compensation value which corresponds to the ready-to-use grayscale compensation interval; and performing compensation on pixel grayscale values of the original image according to the grayscale compensation value; wherein the step of performing compensation on pixel grayscale values of the original image according to the grayscale compensation value further includes a step of: performing compensation, based on the grayscale compensation value, on the pixel grayscale values of the original image to which the predetermined regions correspond.

2. The grayscale adjustment method as claimed in claim 1, wherein the liquid crystal display panel includes at least two pixel rows or at least two pixel columns, and the predetermined region corresponds to the pixel rows or the pixel columns.

3. The grayscale adjustment method as claimed in claim 1, wherein the predetermined grayscale compensation interval is set based on an experience value, and the grayscale compensation value is set based on brightness uniformity testing data of a backlight source.

* * * * *